United States Patent [19]

Orrico

[11] Patent Number: 4,918,270

[45] Date of Patent: Apr. 17, 1990

[54] APPLIANCE SWITCH

[75] Inventor: Mario M. Orrico, Chicago, Ill.

[73] Assignee: Illinois Tool Works, Inc., Glenview, Ill.

[21] Appl. No.: 319,536

[22] Filed: Mar. 6, 1989

[51] Int. Cl.[4] ..... H01H 13/06

[52] U.S. Cl. ..... 200/302.2; 200/293; 200/345

[58] Field of Search ..... 200/293, 302.1, 302.2, 200/303, 307, 345, 401, 405, 410, 411, 412, 415, 424, 429, 430, 468, 471, 454, 456, 457

[56] References Cited

U.S. PATENT DOCUMENTS

| | | | |
|---|---|---|---|
| 2,374,986 | 5/1945 | Fetter | 200/454 |
| 2,892,050 | 6/1959 | Fisher | 200/456 |
| 3,044,594 | 5/1963 | Watson | 200/302.2 |
| 3,317,698 | 5/1967 | Mansfield | 200/302.2 |
| 3,518,391 | 5/1970 | Hipple | 200/303 |

*Primary Examiner*—Henry J. Recla
*Assistant Examiner*—Glenn T. Barrett
*Attorney, Agent, or Firm*—John P. O'Brien; Davis Chin

[57] ABSTRACT

An appliance switch includes a base housing having a pair of trough-like recesses and a cover member having a pair of cylindrically-shaped members. The cylindrically-shaped members are arranged so as to be received snugly within the respective pair of trough-like recesses in order to provide a stabilized engagement. A sealing member consisting of an inverted U-shaped flange is formed on the outer surface of the cover member for creating a tighter sealing contact between the cylindrically-shaped members and the trough-like recesses during the period of switch actuation.

17 Claims, 3 Drawing Sheets

APPLIANCE SWITCH

BACKGROUND OF THE INVENTION

1. Field of the Invention

This invention relates generally to electrical switching devices and more particularly, it relates to an improved appliance switch which includes a unique seal configuration for mating a base housing and a cover member so as to produce a water-tight pushbutton switch.

In view of the increased public awareness for consumer safety in recent years, there has arisen the need of modifying or redesigning of many electrical appliances used in the household so as to prevent consumers from being accidentally electrocuted when such appliances were inadvertently short-circuited with water. As a result, a need has developed for an improved switching device which can be readily used in connection with such electrical appliances but can be operated in the presence of splashing water without creating an electrical hazard.

Although various aplications of the present invention will be readily apparent, the invention is especially useful in conjuction with a washing machine for controlling the motor thereof which requires an effective sealing of the contact switch externally so that it can perform reliably even in the presence of splashing water.

2. Description of the Prior Art

A prior art search directed to the subject matter of this application in the U.S. Patent and Trademark Office revealed the following U.S. Letters Patent:

| | | |
|---|---|---|
| 4,652,706 | 3,049,603 | 3,478,857 |
| 4,501,936 | 3,049,602 | 3,305,660 |
| 4,438,300 | 2,854,536 | 3,296,404 |
| 4,436,965 | 2,409,483 | 3,238,344 |
| Re.29,047 | 2,343,060 | 3,042,764 |
| 3,932,722 | 4,555,600 | 2,812,402 |
| 3,372,246 | 4,298,778 | 2,790,881 |
| 3,317,698 | 4,184,321 | 2,750,480 |
| 3,316,379 | 4,021,630 | 2,451,176 |
| 3,246,112 | 3,790,734 | 2,394,271 |
| 3,054,879 | 3,737,605 | 2,213,649 |

U.S. Pat. Nos. 4,652,706 to Rao et al.; 2,343,060 to Horning; 3,932,722 to Obata et al.; 3,246,112 to Adams et al.; 3,049,603 to Flatt et al.; 3,049,602 to Flatt et al.; 3,317,698 to Mansfield; and 3,054,879 to Soreng disclose switch mechanisms which include one-piece members defining a cover portion, a rolling or flexible seal portion, and an actuator means. U.S. Pat. Nos. 2,854,536 to Beer; 3,790,734 to Raab et al.; and 3,737,605 to Tobey et al. teach generally rolling seals and bellow type seals. The remaining patents uncovered from the search merely teach various integral elastomeric actuators and seals for attachment to a cover or housing and are thus considered to be only of general interest.

However, none of the prior art uncovered in the search disclosed an appliance switch having a base housing and a cover member like that of the present invention which includes a pair of cylindrically-shaped members formed on the interior of the cover member and being received snugly within respective pairs of trough-like recesses formed in the base housing so as to provide a stabilized engagement. Further, a rolling-type seal consisting of an inverted U-shaped flange is formed on the outer surface of the cover member for creating a tighter sealing contact between the cylindrically-shaped members and the trough-like recesses during the period of switch actuation.

SUMMARY OF THE INVENTION

Accordingly, it is a general object of the present invention to provide an improved appliance switch having an integral rolling-type seal which is relatively simple and economical to manufacture and assemble.

It is an object of the present invention to provide an improved appliance switch which includes a unique seal configuration for mating a base housing and a cover member so as to produce a water-tight pushbutton switch.

It is another object of the present invention to provide an improved switching device which can be readily used in conjunction with electrical appliances but can be operated in the presence of splashing water without creating an electrical hazard.

It is still another object of the present invention to provide an improved appliance switch formed of a base housing having a pair of trough-like recesses and a cover member having a pair of cylindrically-shaped members formed on its interior, the cylindrically-shaped members being arranged so as to be received snugly within the respective pair of trough-like recesses so as to provide a stabilized engagement.

It is yet still another object of the present invention to provide an improved appliance switch which is formed of a base housing, a cover member, and a sealing member consisting of an inverted U-shaped flange disposed on the outer surface of the cover member for creating a tighter sealing contact between the cover member and the base housing during switch activation.

In accordance with these aims and objectives, the present invention is concerned with the provision of an improved appliance switch which includes a base housing formed of an insulating material and having a top portion and a bottom portion, and a cover member formed of an elastomeric material and having pushbutton actuator member. The bottom portion of the housing has a cavity for containing a fixed switch contact plate and a movable switch contact strip. The contact plate is formed with a fixed contact, and the contact strip includes an intermediate L-shaped movable portion and a movable contact. A spring is used to engage the L-shaped portion so as to bias the movable contact to be spaced apart from the fixed contact in a first position. The L-shaped portion is movable from the first position to a second position where the movable contact is urged into contacting engagement with the fixed contact in a snap action. The top portion of the housing has an upstanding collar which is axially aligned with a connecting tip of the L-shaped portion. A pair of trough-like recesses are formed on the opposite sides of the upstanding collar.

The actuator member is formed of a dome-shaped portion and annular wall member joined integrally thereto. A lower annular membrane has a radial inner end joined integrally to a lower part of the wall member and a radial outer end. An inverted U-shaped flange is formed integrally with the outer end of the annular membrane to define a rolling-type seal between the housing and the cover member. The cover member has a pair of cylindrically-shaped members disposed on its interior. The cylindrically-shaped members are arranged so as to be received snugly within the respective pair of trough-like recesses in order to provide a stabilized engagement.

An actuating rod extends axially from the inside of the actuating member and is movably positioned within the collar of the housing. The actuating rod has a tip portion which engages the connecting tip of the L-shaped movable portion. The dome-shaped portion is depressed under pressure to push the actuating rod downwardly causing peripheral bending and flexing of the annular membrane and causing the L-shaped portion to move from the first position to the second position. The L-shaped portion is restored to the first position under the bias force of the spring when the pressure is released.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
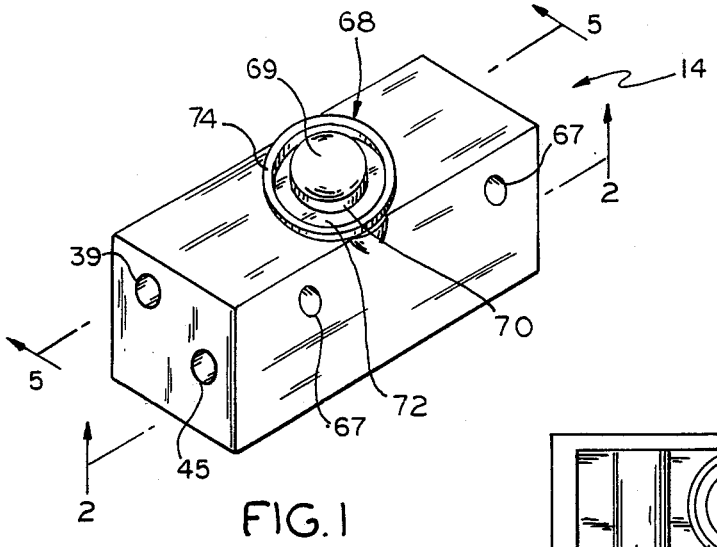
FIG. 1 is a perspective view of a cover member of the appliance switch, constructed in accordance with the principles of the present invention.
Figure 2:
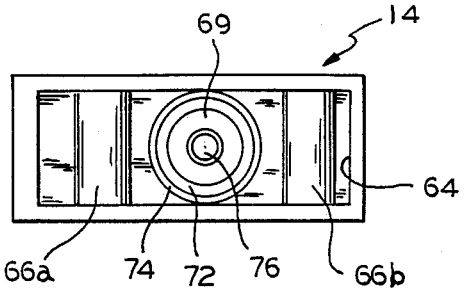
FIG. 2 is a bottom view of the cover member, taken along the lines 2—2 of FIG. 1.
Figure 3:
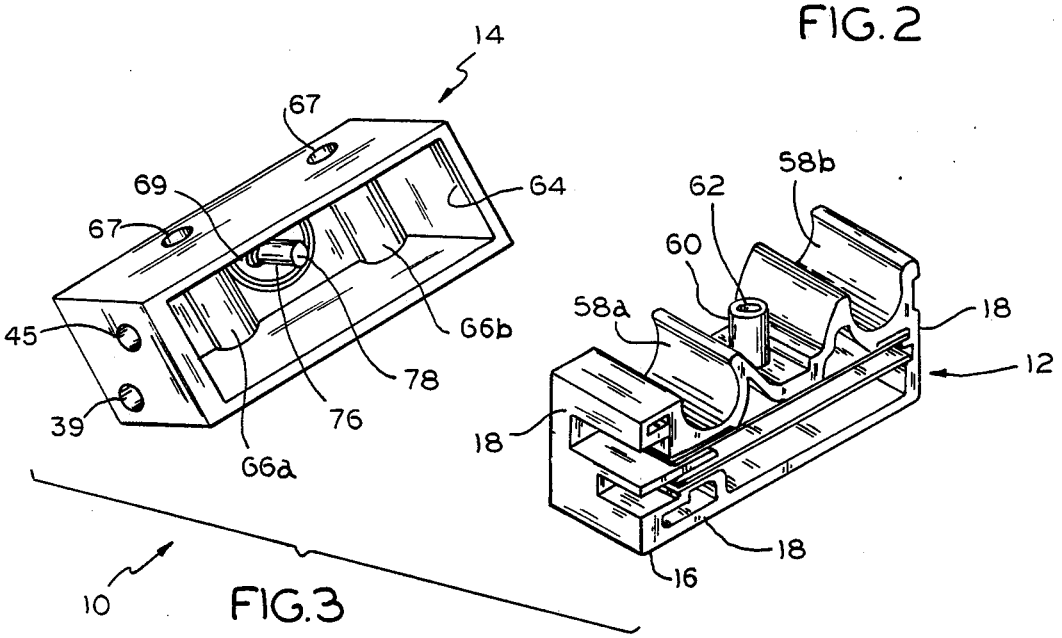
FIG. 3 is an exploded view of the appliance switch.
Figure 4:
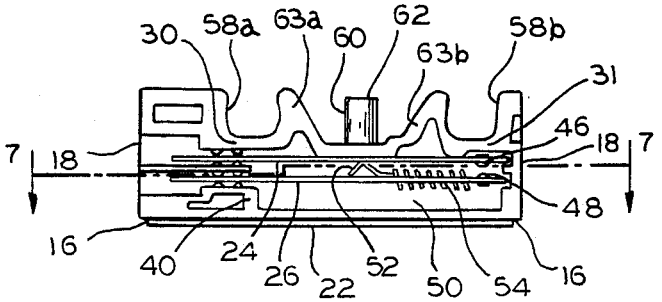
FIG. 4 is a side elevational view of the base housing of the appliance switch.

Referring now in detail to the various view of the drawings and in particular to FIGS. 1–6, there is illustrated an improved appliance switch 10 constructed in accordance with the principles of the present invention. the appliance switch 10 is comprised of a base housing 12 and a cover member 14 which is secured to the base housing by a unique seal configuration in order to achieve a water-tight seal between the housing and the cover member, as will hereinafter be more fully set forth.

The base housing 12 is formed of a generally rectangularly-shaped design and is preferably integrally molded from a suitable electrical insulating material, such as plastic or nylon. The housing 12 includes downward projecting recess 16 which are formed on its four sides 18 and are located above the bottom surface 22. Molded within a bottom portion of the housing 12 are a fixed switch contact plate 24 and a movable switch contact strip 26 which are formed of a suitable material such as beryllium copper. As can be seen, one end 25 of the contact plate 24 is held in place and is sandwiched between a central spacing member 28 and a skirt portion 30. It will be noted that the skirt portion 30 is provided with bumps or beads 32. Further, the central spacing member 28 is provided with upper beads 34 and lower beads 36. The beads 32 and 34 facilitate gripping of the end 25 of contact plate 24. The end 25 of the contact plate 24 is also electrically connected to one end of the insulated wire 38 whose other end is adapted to extend outside of the cover member 14 via opening 39 formed therein. It will be noted that the insulated wire 38 is snugly received in the opening 39 of the cover member 14 to provide a waterproof seal therebetween.

One end 27 of the contact strip 26 is held in place and is sandwiched between the central spacing member 28 and a raised portion 40. The raised portion 40 is also provided with bumps or beads 42. The beads 42 and 36 facilitate gripping of the end 27 of the contact strip 26. The end 27 of the contact strip is also electrically connected to one end of an insulated wire 44 whose other end is adapted to extend outside of the cover member via opening 45 formed therein. Similarly, it will be noted that the insulated wire 44 is snugly received in the opening 45 of the cover member 14 to provide a waterproof seal therebetween.

Figure 5:
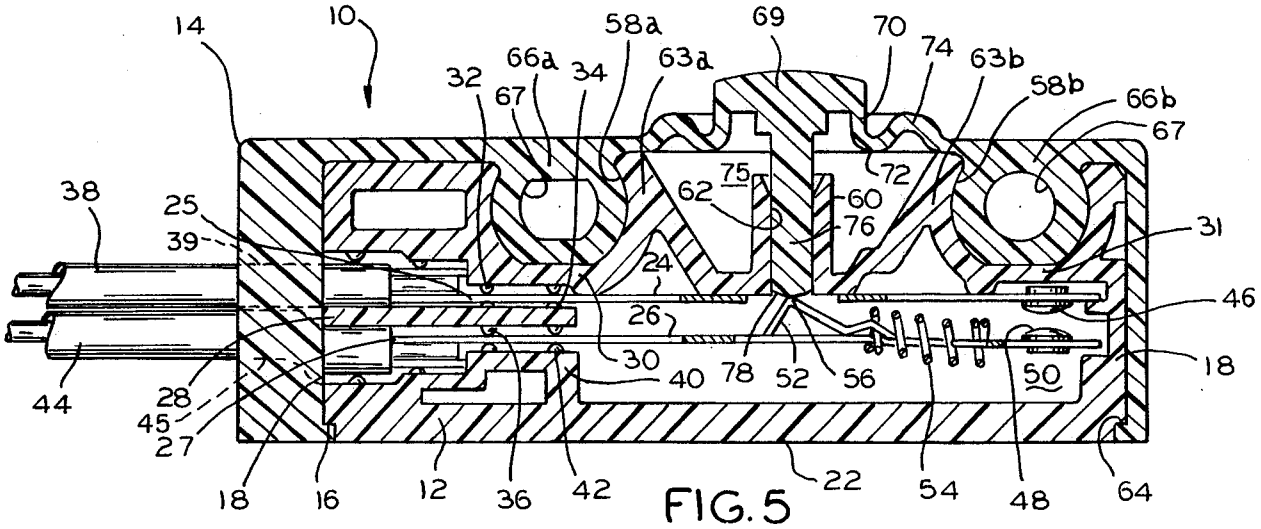
FIG. 5 is a cross-sectional view taken along the lines 5—5 of FIG. 1, of the asssembled appliance switch, illustrating the contacts in the opened position.
Figure 6:
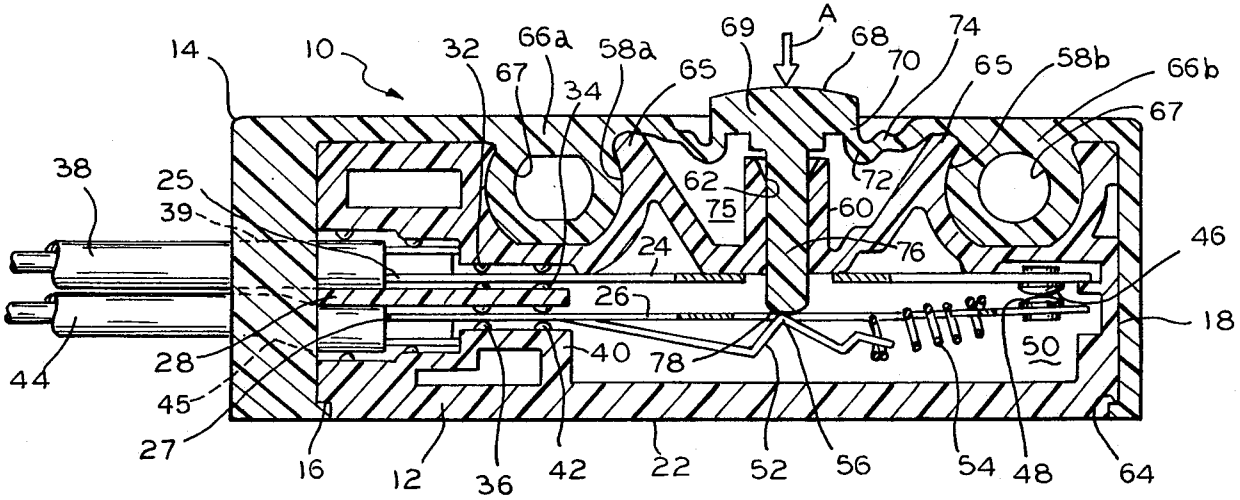
FIG. 6 is a cross-sectional view of the assembled appliance switch similar to FIG. 5, but illustrating the contacts in the closed position.
Figure 7:
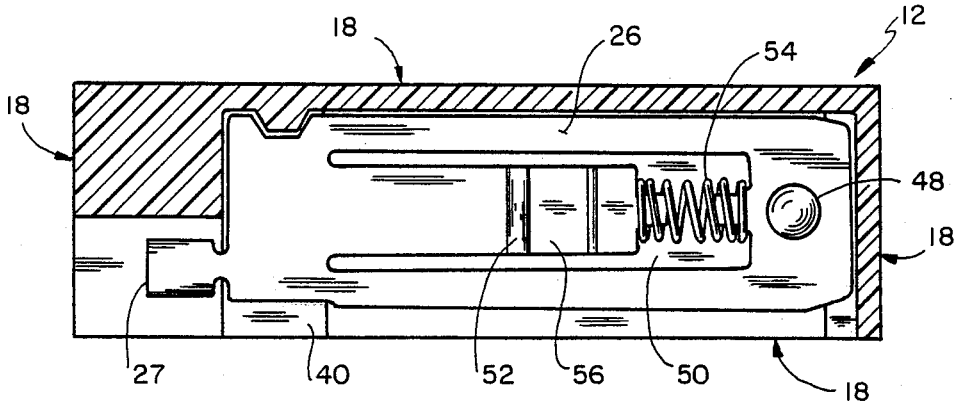
FIG. 7 is a cross-sectional view, taken along the lines 7—7 of FIG. 4, of the appliance switch, illustrating the movable contact strip 26.

The other end of the contact plate 24 is formed with a first or fixed contact 46, and the other end of the contact strip 26 is formed with a second or movable contact 48. These contacts 46 and 48 are positioned within a cavity 50 located in the bottom portion of the housing and may be made of platinum or other contact metal common in the electrical switch art. The contact strip 26 includes an intermediate L-shaped movable portion 52 which is biased by a spring 54 so as to maintain the contact 46 and 48 in the open or separated position, as illustrated in FIG. 5. When the connecting tip 56 of the L-shaped movable portion 52 is depressed or pushed downwardly, the spring 54 will cause the contact 48 to be urged into contacting engagement with the contact 46 with a snap action which will maintain the contact 46 and 48 in the closed position, as shown in FIG. 6.

Molded integrally in the top portion of the base housing 12 are a pair of trough-like recesses **58*a*, 58*b* which are separated by an upstanding sleeve or collar 60 formed with a central opening 62. The bottom portion of central opening 62 is aligned with and just above the connecting tip 56 of the L-shaped movable portion 52 of the contact strip 26. It will be noted that the lower part of the recess 58*a* is defined by the skirt portion 30. A similar skirt portion 31 defines the lower part of the recess 58*b*. Further, one side of the recess 58*a* adjacent to the collar 60 is defined by an outwardly sloping support member 63*a*. In a similar manner, one side of the recesses 58*b* adjacent to the collar 60 is defined by an outwardly sloping support member 63*b***.

The cover member 14 is preferably integrally molded from a suitable elastomeric material such as rubber, and is dimensioned and configured to snap over the base housing in a waterproof sealing relationship. In this connection, the cover member includes a flange 64 which is designed to receive therein the downwardly projecting recess 16 of the housing in order to achieve a water-tight seal between the cover member and the housing. In addition, on the underside of the interior portion of the cover member, there are provided a pair of hollow cylindrically-shaped members **66*a*, 66*b* (FIG. 3) which are positioned so as to be received snugly within the respective trough-like recesses 58*a*, 58*b* of the housing in order to provide a stabilized engagement between the cover member and the housing. It will be noted that each of the hollow cylindrically-shaped members 66*a*, 66*b* is provided with a circular opening 67** extending through its central portion.

In the intermediate area of the top surface of the cover member, there is formed integrally a pushbutton actuator member 68. The actuator member 68 includes a dome-shaped portion 69 and an annular wall member 70 which is joined integrally thereto. A lower annular membrane 72 has its radial inner end joined integrally to a lower part of the wall member 70. An inverted U-shaped flange 74 is formed on the outer surface of the cover member and is formed integrally with a radial outer end of the annular membrane 72 so as to define a rolling-type seal between the housing and the cover member. Extending axially from the inside of the actuator member 68, there is provided an integral actuating rod 76 which is axially aligned to be received within the collar 60. The tip 78 of the actuating rod 76 rests upon the connecting tip 56 of the L-shaped movable portion 52 of the contact strip 26, as shown in FIG. 5.

When pressure is applied more or less to the central area of the dome-shaped portion 69 of the actuator member in the direction of arrow A in FIG. 6, the actuating rod 76 is pushed downwardly so as to cause peripheral bending and flexing of the annular membrane 72 to take place. As a result, the inverted U-shaped flange 74 is collapsed uniformly inwardly when the dome-shaped portion 69 is depressed so as to create a tighter sealing contact between the cylindrically-shaped members 66*a*, 66*b* and the trough-like recesses 58*a*, 58*b*. Due to the presence of the outwardly sloping support members 63*a* and 63*b*, the collar 60 is not deformed so that the central opening 62 is not displaced within the cavity 50. It will be noted that an upper section 65 of the support members engages firmly the underneath side of the outer end of the U-shaped flange 74. As a result, it can be seen that the flange 74 is distorted inwardly and downwardly into a hollow area 75 between the collar 60 and the support members 63*a*, 63*b*, thereby inherently exerting added pressure between the support members forming a part of the trough-like recesses 58*a*, 58*b* and the portions of the cylindrically-shaped members adjacent the respective support members.

When actuating rod 76 is pushed downwardly its tip 78 contacts connecting tip 56 so that the L-shaped portion 52 is moved downwardly and the spring 54 will cause the movable contact 48 to snap into contact engagement with the fixed contact 46, as shown in FIG. 6. When the pressure is released, the annular membrane 72 provides a spring action which removes the pressure between the tip 78 of the actuating rod 76 and the connecting tip 56 of the L-shaped movable portion 52. Therefore, the L-shaped movable portion 52 will be restored to its original position under the bias force of the spring 54, as illustrated in FIG. 5.

From the foregoing detailed description, it can thus be seen that the presennt invention provides an improved appliance switch which includes a base housing having a pair of trough-like recesses and a cover member having a pair of cylindrically-shaped members being disposed on its interior. The cylindrically-shaped members are arranged so as to be received snugly within the respective pair of trough-like recesses in order to provide a stabilized engagement. Further, there is provided a sealing member consisting of an inverted U-shaped flange formed on the outer surface of the cover member for creating a tighter sealing contact between the cylindrical-shaped members and the trough-like recesses during the period of switch actuation.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An appliance switch comprising:

a base housing formed of an insulating material and having a top portion and a bottom portion;

said bottom portion of said housing having a fixed switch contact plate and a movable switch contact strip disposed in a cavity thereof;

said contact plate being formed with a fixed contact and said contact strip having an intermediate L-shaped movable portion and a movable contact;

a spring engaging said L-shaped portion so as to bias said movable contact to be spaced apart from said fixed contact in a first contact in a first position;

said L-shaped portion being movable from the first position to a second position where said movable contact is urged into contacting engagement with said fixed contact in a snap action;

said top portion of said housing having an upstanding collar which is axially aligned with a connecting tip of said L-shaped portion;

a pair of trough-like recesses being formed on opposite sides of said upstanding collar;

a cover member formed of an elastomeric material and having a pushbutton actuator member;

said actuator member being formed of a dome-shaped portion and an annular wall member joined integrally thereto;

a lower annular membrane having a radial inner end joined integrally to a lower part of said wall member and a radial outer end;

an inverted U-shaped flange being formed on an outer surface of said housing and being formed integrally with the outer end of said annular membrane to define a rolling-type seal between said housing and said cover member;

said cover member having a pair of cylindrically-shaped members being disposed on its interior, said cylindrically-shaped members being arranged so as to be received snugly within the respective pair of tough-like recesses in order to provide a stabilized engagement;

an actuating rod extending axially from said actuator member and being movably positioned within said collar of said housing, said actuating rod having a tip portion engaging the connecting tip of said L-shaped movable portion;

said dome-shaped portion being depressed under pressure to push said actuating rod downwardly causing peripheral bending and flexing of said annular membrane and causing said L-shaped portion to move from the first position to the second position; and said L-shaped movable portion being restored to the first position under the bias force of said spring when the pressure is released.

2. An appliance switch as claimed in claim 1, wherein said insulating material comprises plastic.

3. An appliance switch as claimed in claim 1, wherein said elastomeric material comprises rubber.

4. An appliance switch as claimed in claim 1, wherein said fixed contact is positioned on one end of said switch contact plate, and wherein the other end of said contact plate is sandwiched between a central spacing member and a skirt portion.

5. An appliance switch as claimed in claim 4, wherein said movable contact is positioned on one end of said contact strip, and wherein the other end of said contact strip is sandwiched between said central spacing member and a raised portion.

6. An appliance switch as claimed in claim 5, wherein said central spacing member and said skirt portion are provided with beads for facilitating gripping of said other end of said contact plate.

7. An appliance switch as claimed in claim 6, wherein said central portion and said raised portion are provided with beads for facilitating gripping of said other end of said contact strip.

8. An appliance switch as claimed in claim 1, wherein said cylindrically-shaped members are hollow.

9. An appliance switch as claimed in claim 1, wherein each of said trough-like recesses is defined by an outwardly sloping support member which engages an outer end of said inverted U-shaped flange.

10. An appliance switch comprising:

a base housing formed of an insulating material and having a top portion and a bottom portion;

said bottom portion of said housing having a fixed contact and a movable contact disposed in a cavity thereof, said movable contact being movable between a first position where it is spaced from said fixed contact and a second position where it is urged into engagement therewith in a snap action;

said top portion of said housing having an upstanding collar and a pair of trough-like recesses formed on opposite sides of said upstanding collar;

a cover member formed of an elastomeric material and having a pushbutton actuator member;

said actuator member being formed of a dome-shaped portion and an annular wall member joined integrally thereto;

a lower annular membrane having a radial inner end joined integrally to a lower part of said wall member and a radial outer end;

an inverted U-shaped flange being formed on an outer surface of said housing and being formed integrally with the outer end of said annular membrane to define a roll-type seal between said housing and said cover member;

said cover member having a pair of cylindrically-shaped members being disposed on its interior, said cylindrically-shaped members being arranged so as to be received snugly within the respective pair of trough-like recesses in order to provide a stabilized engagement; and an actuating rod extending axially from said actuating member and being movable positioned within said collar of said housing, said actuating rod causing said movable contact to move from the first position to the second position when said actuating member is depressed.

11. An appliance switch as claimed in claim 10, wherein said insulating material comprises plastic.

12. An appliance switch as claimed in claim 10, wherein said elastomeric material comprises rubber.

13. An appliance switch as claimed in claim 10, wherein said cylindrically-shaped members are hollow.

14. An appliance switch as claimed in claim 10, wherein each of said trough-like recesses is defined by an outwardly sloping support member which engages an outer end of said inverted U-shaped flange.

15. An appliance switch comprising:

a base housing formed of an insulating material and having a top portion and a bottom portion;

said bottom portion of said housing having a fixed contact and a movable contact disposed in a cavity thereof, said movable contact being movable between a first position where it is spaced from said fixed contact and a second position where it is urged into engagement therewith in a snap action;

said top portion of said housing having an upstanding collar and a pair of trough-like recesses formed on opposite sides of said upstanding collar;

a cover member formed of an elastomeric material and having integral actuator means for moving said movable contact from the first to the second position;

said cover member having a pair of cylindrically-shaped members being disposed on an interior, said cylindrically-shaped members being arranged so as to be received snugly within the respective pair of trough-like recesses in order to provide a stabilized engagement; and sealing means including an inverted U-shaped flange formed on an outer surface of said cover member for creating a seal between said cover member and said trough-like recesses formed in said top portion of said base housing.

16. An appliance switch as claimed in claim 15, wherein said cylindrically-shaped members are hollow.

17. An appliance switch as claimed in claim 15, wherein each of said trough-like recesses is defined by an outwardly sloping support member which engages an outer end of said inverted U-shaped flange.

* * * * *